US008184834B2

(12) United States Patent
Oh et al.

(10) Patent No.: US 8,184,834 B2
(45) Date of Patent: May 22, 2012

(54) CONTROLLER AND USER INTERFACE FOR DIALOGUE ENHANCEMENT TECHNIQUES

(75) Inventors: Hyen-O Oh, Goyang-si (KR); Yang-Won Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 1119 days.

(21) Appl. No.: 11/855,570

(22) Filed: Sep. 14, 2007

(65) Prior Publication Data

US 2008/0165286 A1 Jul. 10, 2008

Related U.S. Application Data

(60) Provisional application No. 60/844,806, filed on Sep. 14, 2006, provisional application No. 60/884,594, filed on Jan. 11, 2007, provisional application No. 60/943,268, filed on Jun. 11, 2007.

(51) Int. Cl.
*H04R 5/02* (2006.01)

(52) U.S. Cl. ..... 381/300; 381/109; 381/58; 348/738

(58) Field of Classification Search ..... 381/300, 381/26, 27, 109, 58, 98, 104, 107; 700/94; 375/260; 348/569, 738
See application file for complete search history.

(56) References Cited

U.S. PATENT DOCUMENTS

| | | | | |
|---|---|---|---|---|
| 3,519,925 | A | 7/1970 | Ansley et al. | |
| 4,897,878 | A | 1/1990 | Boll et al. | |
| 5,737,331 | A | 4/1998 | Hoppal et al. | |
| 6,111,755 | A * | 8/2000 | Park | 361/727 |
| 6,243,476 | B1 | 6/2001 | Gardner | |
| 6,470,087 | B1 | 10/2002 | Heo et al. | |
| 6,813,600 | B1 * | 11/2004 | Casey et al. | 704/200.1 |
| 6,990,205 | B1 | 1/2006 | Chen | |
| 7,016,501 | B1 | 3/2006 | Aylward et al. | |
| 7,085,387 | B1 * | 8/2006 | Metcalf | 381/26 |
| 7,307,807 | B1 | 12/2007 | Han et al. | |
| 2002/0116182 | A1 | 8/2002 | Gao et al. | |
| 2003/0039366 | A1 | 2/2003 | Eid et al. | |
| 2004/0193411 | A1 | 9/2004 | Hui et al. | |
| 2005/0117761 | A1 | 6/2005 | Sato | |
| 2005/0152557 | A1 | 7/2005 | Sasaki et al. | |
| 2006/0008091 | A1 | 1/2006 | Kim et al. | |
| 2006/0029242 | A1 * | 2/2006 | Metcalf | 381/300 |
| 2006/0074646 | A1 | 4/2006 | Alves et al. | |

(Continued)

FOREIGN PATENT DOCUMENTS

EP 0865227 9/1998

(Continued)

OTHER PUBLICATIONS

Extended European Search Report and Written Opinion for Application No. EP 07858967.8, dated Sep. 10, 2009, 5 pages.

(Continued)

*Primary Examiner* — Vivian Chin
*Assistant Examiner* — Friedrich W Fahnert
(74) *Attorney, Agent, or Firm* — Fish & Richardson P.C.

(57) ABSTRACT

A plural-channel audio signal (e.g., a stereo audio) is processed to modify a gain (e.g., a volume level or loudness) of an estimated dialogue signal (e.g., dialogue spoken by actors in a movie) relative to other signals (e.g., reflected or reverberated sound). In some aspects, a controller is used to control master volume and dialogue volume. In some aspects, one or more graphical objects and/or user interface elements are used to indicate volume levels and other information.

15 Claims, 10 Drawing Sheets

U.S. PATENT DOCUMENTS

| | | | | |
|---|---|---|---|---|
| 2006/0115103 | A1 | 6/2006 | Feng et al. | |
| 2006/0139644 | A1 | 6/2006 | Kahn et al. | |
| 2006/0159190 | A1 * | 7/2006 | Wu et al. | 375/260 |
| 2006/0198527 | A1 | 9/2006 | Chun | |
| 2009/0003613 | A1 | 1/2009 | Christensen | |

FOREIGN PATENT DOCUMENTS

| | | |
|---|---|---|
| EP | 1 187 101 | 3/2002 |
| GB | 2353926 | 3/2001 |
| JP | 03-285500 | 12/1991 |
| JP | 04-249484 | 9/1992 |
| JP | 05-183997 | 7/1993 |
| JP | 05-088100 | 11/1993 |
| JP | 05-292592 | 11/1993 |
| JP | 06-070400 | 3/1994 |
| JP | 06-253398 | 9/1994 |
| JP | 06-335093 | 12/1994 |
| JP | 07-115606 | 5/1995 |
| JP | 08-222979 | 8/1996 |
| JP | 11-289600 | 10/1999 |
| JP | 2000-115897 | 4/2000 |
| JP | 2001-245237 | 9/2001 |
| JP | 2001-289878 | 10/2001 |
| JP | 2002-078100 | 3/2002 |
| JP | 2002-101485 | 4/2002 |
| JP | 2002-247699 | 8/2002 |
| JP | 2003-084790 | 3/2003 |
| JP | 2004-343590 | 12/2004 |
| JP | 2005-086462 | 3/2005 |
| JP | 2005/125878 | 5/2005 |
| JP | 3118519 | 1/2006 |
| JP | 2006222686 | 8/2006 |
| RU | 98121130 | 11/1997 |
| WO | 99/04498 | 1/1999 |
| WO | 2005/099304 | 10/2005 |

OTHER PUBLICATIONS

Office Action, Japanese Appln. No. 2009-527925, dated Apr. 12, 2011, 10 pages with English translation.

Office Action, Japanese Appln. No. 2009-527920, dated Apr. 19, 2011, 10 pages with English translation.

Faller et al., "Binaural Cue Coding—Part II: Schemes and Applications" IEEE Transactions on Speech and Audio Processing, IEEE Service Center, New York, NY, vol. 11, No. 6., Oct. 6, 2003, 12 pages.

International Organization for Standardization, "Concepts of Object-Oriented Spatial Audio Coding", Jul. 21, 2006, 8 pages.

PCT International Search report corresponding to PCT/EP2007/008028, dated Jan. 22, 2008, 4 pages.

PCT International Search Report in corresponding PCT application # PCT/IB2007/003073, dated May 27, 2008, 3 pages.

Notice of Allowance, Russian Application No. 2009113806, mailed Jul. 2, 2010, 16 pages with English translation.

Office Action, Japanese Appln. No. 2009-527747, dated Apr. 6, 2011, 10 pages with English translation.

Office Action, U.S. Appl. No. 11/855,500, dated Oct. 11, 2011, 21 pages.

Office Action, U.S. Appl. No. 11/855,576, dated Oct. 12, 2011, 12 pages.

Office Action, U.S. Appl. No. 11/855,500, dated Feb. 16, 2012, 8 pages.

* cited by examiner

CONTROLLER AND USER INTERFACE FOR DIALOGUE ENHANCEMENT TECHNIQUES

RELATED APPLICATIONS

This patent application claims priority from the following co-pending U.S. Provisional Patent Applications:

- U.S. Provisional Patent Application No. 60/844,806, for "Method of Separately Controlling Dialogue Volume," filed Sep. 14, 2006;
- U.S. Provisional Patent Application No. 60/884,594, for "Separate Dialogue Volume (SDV)," filed Jan. 11, 2007; and
- U.S. Provisional Patent Application No. 60/943,268, for "Enhancing Stereo Audio with Remix Capability and Separate Dialogue," filed Jun. 11, 2007.

Each of these provisional patent applications are incorporated by reference herein in its entirety.

TECHNICAL FIELD

The subject matter of this patent application is generally related to signal processing.

BACKGROUND

Audio enhancement techniques are often used in home entertainment systems, stereos and other consumer electronic devices to enhance bass frequencies and to simulate various listening environments (e.g., concert halls). Some techniques attempt to make movie dialogue more transparent by adding more high frequencies, for example. None of these techniques, however, address enhancing dialogue relative to ambient and other component signals.

SUMMARY

A plural-channel audio signal (e.g., a stereo audio) is processed to modify a gain (e.g., a volume level or loudness) of an estimated dialogue signal (e.g., dialogue spoken by actors in a movie) relative to other signals (e.g., reflected or reverberated sound). In some aspects, a controller is used to control master volume and dialogue volume. In some aspects, one or more graphical objects and/or user interface elements are used to indicate volume levels and other information.

Other implementations are disclosed, including implementations directed to methods, systems and computer-readable mediums.

DETAILED DESCRIPTION

Dialogue Enhancement Techniques

Figure 1:
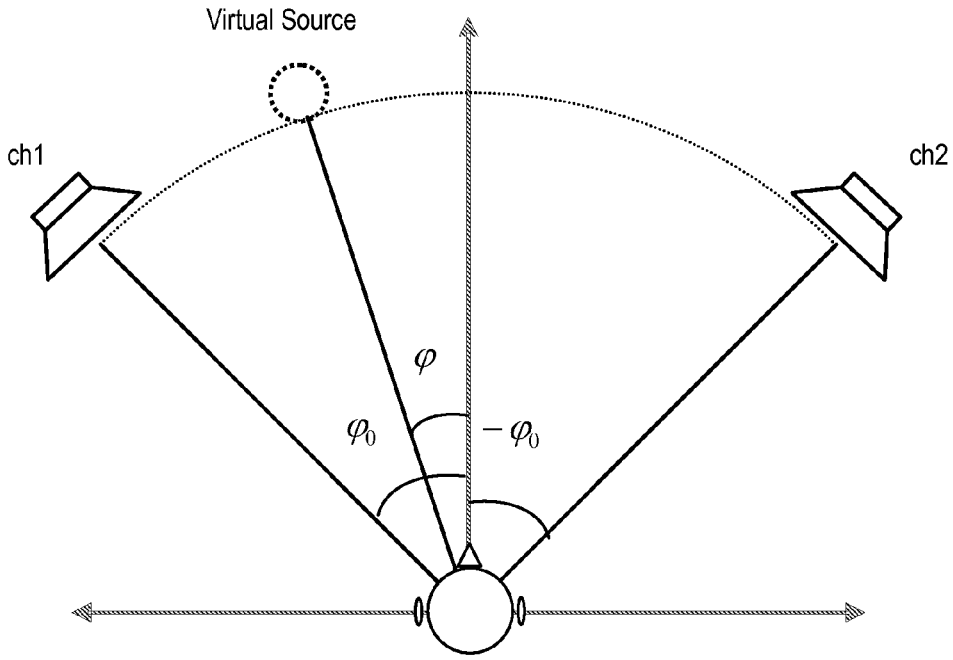
FIG. 1 illustrates a model for representing channel gains as a function of a position of a virtual sound source using two speakers.

FIG. 1 illustrates a model for representing channel gains as a function of a position of a virtual sound source using two speakers. In some implementations, a method of controlling only the volume of a dialogue signal included in an audio/video signal is capable of efficiently controlling the dialogue signal according to a demand of a user, in a variety of devices for reproducing an audio signal, including a Television (TV) receiver, a digital multimedia broadcasting (DMB) player, or a personal multimedia player (PMP).

When only a dialogue signal is transmitted in an environment where background noise or transmission noise does not occur, a listener can listen to the transmitted dialogue signal without difficulty. If the volume of the transmitted dialogue signal is low, the listener can listen to the dialogue signal by turning up the volume. In an environment where a dialogue signal is reproduced together with a variety of sound effects in a theater or a television receiver for reproducing movie, drama or sports, a listener may have difficulty hearing the dialogue signal, due to music, sound effects and/or background or transmission noise. In this case, if the master volume is turned up to increase the dialogue volume, the volume of the background noise, music and sound effects are also turned up, resulting in an unpleasant sound.

In some implementations, if a transmitted plural-channel audio signal is a stereo signal, a center channel can be virtually generated, a gain can be applied to the virtual center channel, and the virtual center channel can be added to the left and right (L/R) channels of the plural-channel audio signal. The virtual center channel can be generated by adding the L channel and the R channel:

$$C_{virtual}=L_{in}+R_{in},$$

$$C_{out}=f_{center}(G_{center}\times C_{virtual}),$$

$$L_{out}=G_L\times L_{in}+C_{out},$$

$$R_{out}=G_R\times R_{in}+C_{out}, \quad [1]$$

where, $L_{in}$ and $R_{in}$ denote the inputs of the L and R channels, $L_{out}$ and $R_{out}$ denote the outputs of the L and R channels, $C_{virtual}$ and $C_{out}$, respectively, denote a virtual center channel and the output of the processed virtual center channel, both of which are values used in an intermediate process, $G_{center}$ denotes a gain value for determining the level of the virtual center channel, and $G_L$ and $G_R$ denote gain values applied to the input values of the L and R channels. In this example, it is assumed that $G_L$ and $G_R$ are 1.

In addition, a method of applying one or more filters (e.g., a band pass filter) for amplifying or attenuating a specific frequency, as well as applying gain to the virtual center channel, can be used. In this case, a filter may be applied using a function $f_{center}$. If the volume of the virtual center channel is turned up using $G_{center}$, there is a limitation that other component signals, such as music or sound effects, contained in the L and R channels as well as the dialogue signal are amplified. If the band pass filter using $f_{center}$ is used, dialogue articulation is improved, but the signals such as dialogue, music and background sound are distorted resulting in an unpleasant sound.

As will be described below, in some implementations, the problems described above can be solved by efficiently controlling the volume of a dialogue signal included in a transmitted audio signal.

Method of Controlling Volume of Dialogue Signal

In general, a dialogue signal is concentrated to a center channel in a multi-channel signal environment. For example, in a 5.1, 6.1 or a 7.1 channel surround system, dialogue is generally allocated to the center channel. If the received audio signal is a plural-channel signal, sufficient effect can be obtained by controlling only the gain of the center channel. If an audio signal does not contain the center channel (e.g., stereo), there is a need for a method of applying a desired gain to a center region (hereinafter, also referred to as a dialogue region) to which a dialogue signal is estimated to be concentrated from a channel of a plural-channel audio signal.

Multi-Channel Input Signal Containing Center Channel

The 5.1, 6.1 or 7.1 channel surround systems contain a center channel. With these systems, a desired effect can be sufficiently obtained by controlling only the gain of the center channel. In this case, the center channel indicates a channel to which dialogue is allocated. The disclosed dialogue enhancement techniques disclosed herein, however, are not limited to the center channel:

Output Channel Contains a Center Channel

In this case, if a center channel is C_out and an input center channel is C_in, the following equation may be obtained:

$$C_out=f_center(G_center*C_in), \quad [2]$$

where, G_center denotes a desired gain and f_center denotes a filter (function) applied to the center channel, which may be configured according to the use. As necessary, G_center may be applied after f_center is applied.

$$C_out=G_center*f_center(C_in), \quad [3]$$

Output Channel does not Contain a Center Channel

If the output channel does not contain the center channel, C_out (of which the gain is controlled by the above-described method) is applied to the L and R channels. This is given by $$L_{out}=G_L\times L_{in}+C_{out},$$

$$R_{out}=G_R\times R_{in}+C_{out}. \quad [4]$$

To maintain signal power, C_out can be calculated using an adequate gain (e.g., 1/sqrt(2)).

Plural-Channel Input Signal Containing No Center Channel

If the center channel is not contained in the plural-channel audio signal, a dialogue signal (also referred to as a virtual center channel signal) where dialogue is estimated to be concentrated can be obtained from the plural-channel audio signal, and a desired gain can be applied to the estimated dialogue signal. For example, audio signal characteristics (e.g., level, correlation between left and right channel signals, spectral components) can be used to estimate the dialogue signal, such as described in, for example, U.S. patent application Ser. No. 11/855,500, for "Dialogue Enhancement Techniques," filed Sep. 14, 2007, which patent application is incorporated by reference herein in its entirety.

Referring again to FIG. 1, according to the sine law, when a sound source (e.g., the virtual source in FIG. 1) is located at any position in a sound image, the gains of channels can be controlled to express the position of the sound source in the sound image using two speakers:

$$x_i(k) = g_i x(k), \quad [5]$$

$$\frac{\sin\varphi}{\sin\varphi_0} = \frac{g_1 - g_2}{g_1 + g_2}.$$

Note that instead of a sine function a tangent function may be used.

In contrast, if the levels of the signals input to the two speakers, that is, $g_1$ and $g_2$, are known, the position of the sound source of the signal input can be obtained. If a center speaker is not included, a virtual center channel can be obtained by allowing a front left speaker and a front right speaker to reproduce sound which will be contained in the center speaker. In this case, the effect that the virtual source is located at the center region of the sound image is obtained by allowing the two speakers to give similar gains, that is, $g_1$ and $g_2$, to the sound of the center region. In the sine-law equation, if $g_1$ and $g_2$ have similar values, the numerator of the right term is close to 0. Accordingly, a sin $\phi$ should have a value close to 0, that is, a $\phi$ should have a value close to 0, thereby positioning the virtual source at the center region. If the virtual source is positioned at the center region, the two channels for forming the virtual center channel (e.g., left and right channels) have similar gains, and the gain of the center region (i.e., the dialogue region) can be controlled by controlling the gain value of the estimated signal of the virtual center channel.

Information on the levels of the channels and correlation between the channels can be used to estimate a virtual center channel signal, which can be assumed to contain dialogue. For example, if the correlation between the left and right channels is low (e.g., an input signal is not concentrated to any position of the sound image or is widely distributed), there is a high probability that the signal is not dialogue. On the other hand, if the correlation between the left and right channels is high (e.g., the input signal is concentrated to a position of the space), then there is a high probability that the signal is dialogue or a sound effect (e.g., noise made by shutting a door).

Accordingly, if the information on the levels of the channels and the correlation between the channels are simultaneously used, a dialogue signal can be efficiently estimated.

Since the frequency band of the dialogue signal is generally in 100 Hz to 8 KHz, the dialogue signal can be estimated using additional information in this frequency band.

A general plural-channel audio signal can include a variety of signals such as dialogue, music and sound effects. Accordingly, it is possible to improve the estimation capability of the dialogue signal by configuring a classifier for determining whether the transmitted signal is dialogue, music or another signal before estimating the dialogue signal. The classifier may also be applied after estimating the dialogue signal to determine whether the estimate was accurate, as described in reference to FIGS. 5A-5C.

Control in Time Domain

Figure 2:
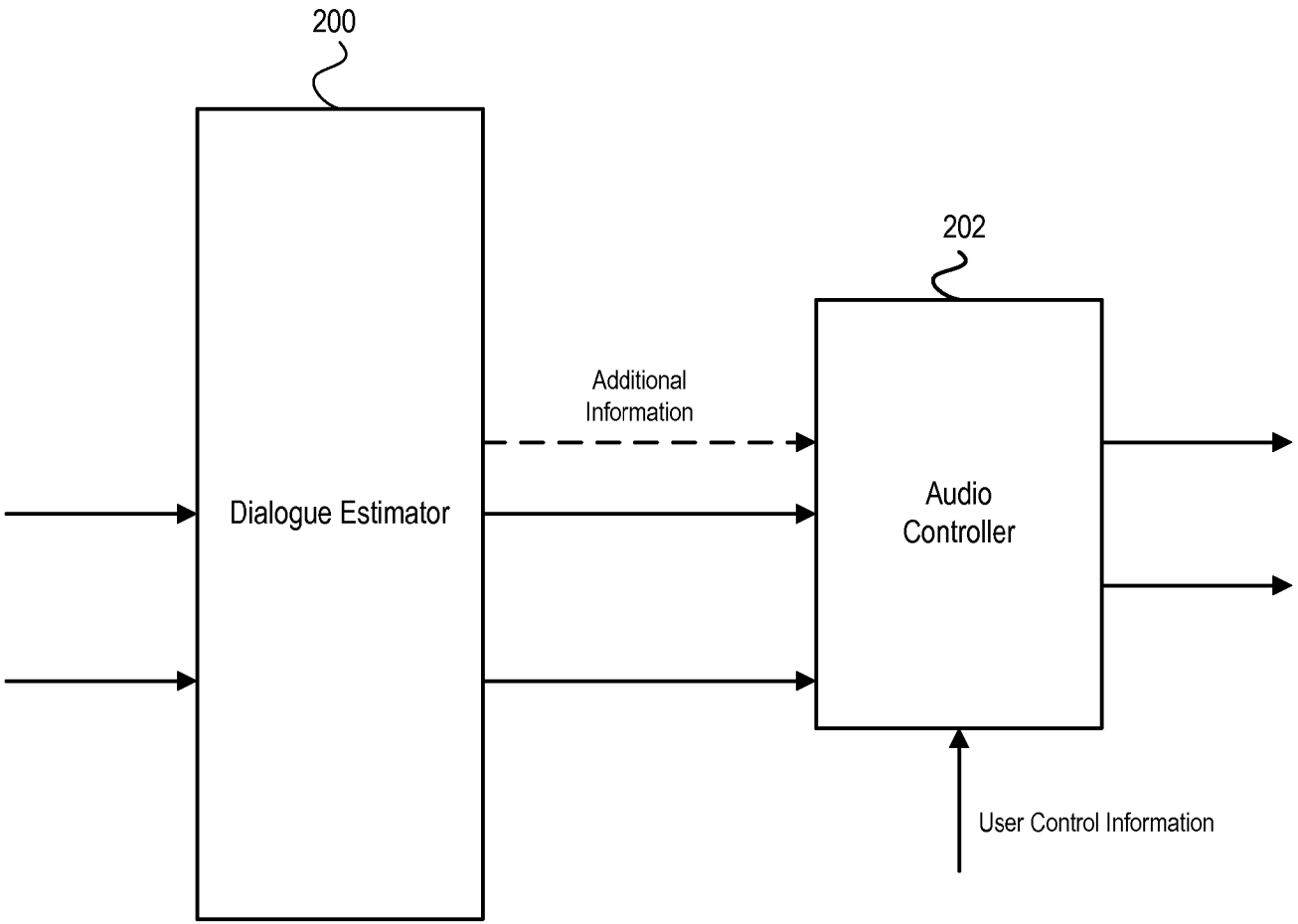
FIG. 2 is a block diagram of an example dialogue estimator and audio controller for enhancing dialogue in an input signal.

FIG. 2 is a block diagram of an example dialogue estimator 200 and audio controller 202. As can be seen from FIG. 2, a dialogue signal is estimated by the dialogue estimator 200 using an input signal. A desired gain (e.g., specified by a user) can be applied to the estimated dialogue signal using the audio controller 202, thereby obtaining an output. Additional information necessary for controlling the gain may be generated by the dialogue estimator 200. User control information may contain dialogue volume control information. An audio signal can be analyzed to identify music, dialogue, reverberation, and background noise, and the levels and properties of these signals can be controlled by the audio controller 202.

Subband Based Processing

Figure 3:
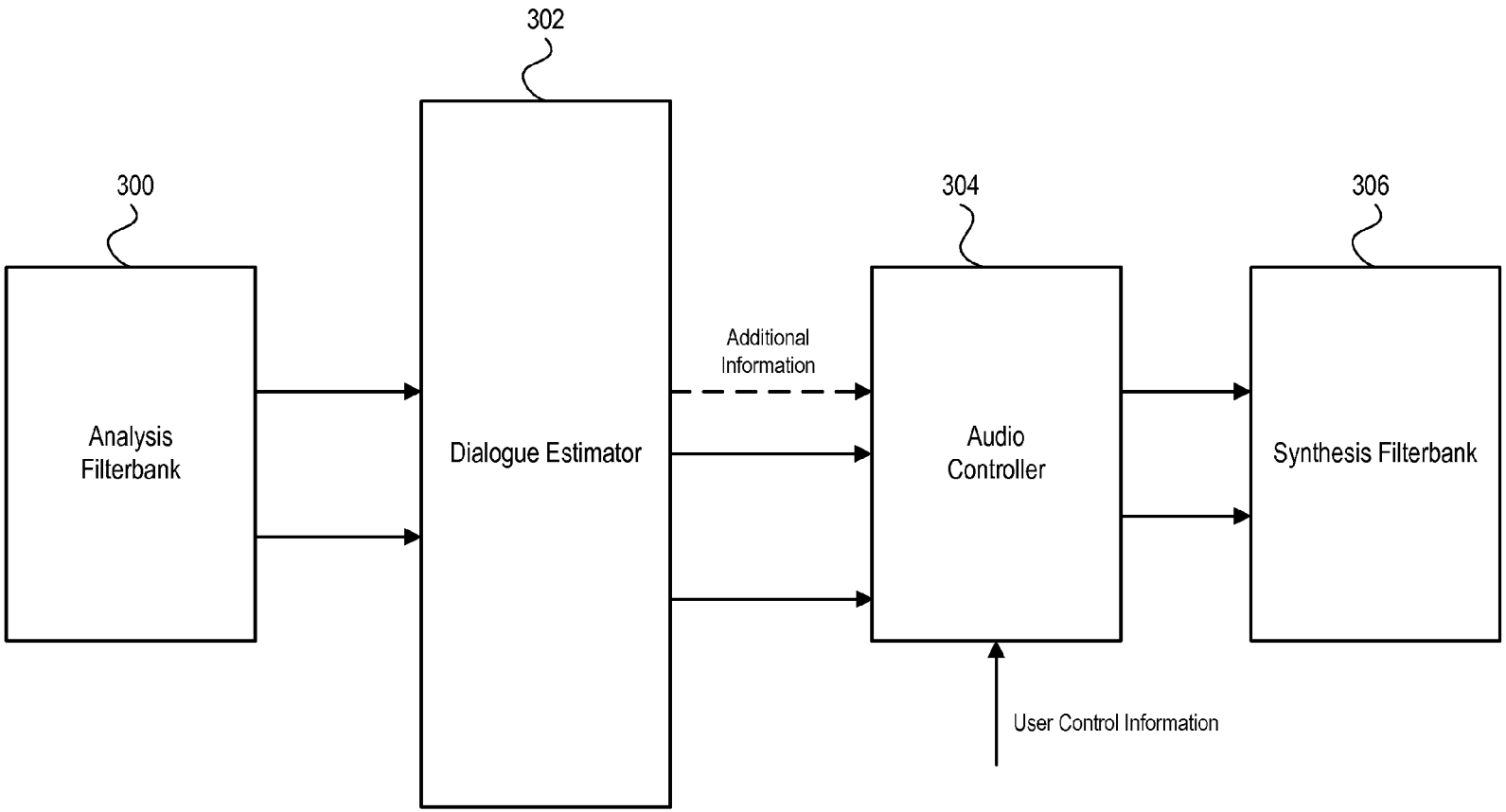
FIG. 3 is a block diagram of an example dialogue estimator and audio controller for enhancing dialogue in an input signal, including a filterbank and inverse transform.

FIG. 3 is a block diagram of an example dialogue estimator 302 and audio controller 304 for enhancing dialogue in an input signal, including an analysis filterbank 300 and synthesis filterbank 306 for generating subbands from an audio signal, and for synthesizing the audio signal from the subbands, respectively. Rather than estimating and controlling the dialogue signal with respect to the whole band of the input audio signal, in some implementations it may be more efficient that the input audio signal is divided into a plurality of subbands by the analysis filterbank 300, and the dialogue signal is estimated by the dialogue estimator 302 according to the subbands. In some cases, dialogue may or may not be concentrated in a specific frequency region of the input audio signal. In such cases, only the frequency region of the input audio signal containing dialogue can be used to estimate the dialogue region. A variety of known methods can be used for obtaining subband signals, including but not limited to: polyphase filterbank, quadrature mirror filterbank (QMF), hybrid filterbank, discrete Fourier transform (DFT), modified discrete cosine transform (MDCT), etc.

In some implementations, a dialogue signal can be estimated in a frequency domain by filtering a first plural-channel audio signal to provide left and right channel signals; transforming the left and right channel signals into a frequency domain; and estimating the dialogue signal using the transformed left and right channel signals.

Use of Classifier

Figure 4:
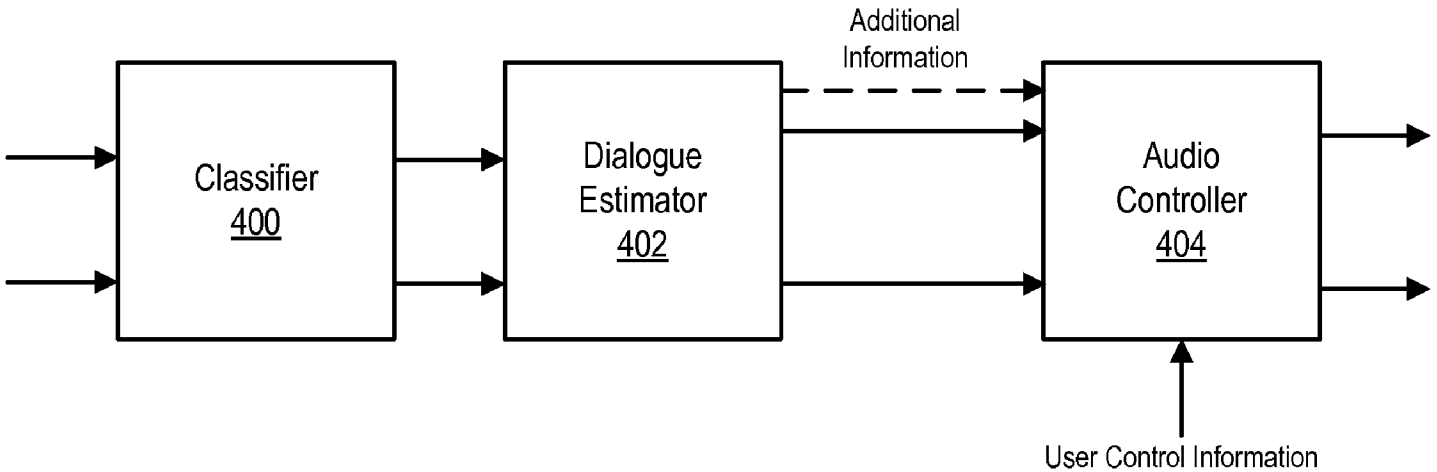
FIG. 4 is a block diagram of an example dialogue estimator and audio controller for enhancing dialogue in an input signal, including a classifier for classifying component signals contained in an audio signal or estimated dialogue signal.

FIG. 4 is a block diagram of an example dialogue estimator 402 and audio controller 404 for enhancing dialogue in an input signal, including a classifier 400 for classifying audio content contained in an audio signal. In some implementations, the classifier 400 can be used to classify an input audio signal into categories by analyzing statistical or perceptible characteristics of the input audio signal. For example, the classifier 400 can determine whether an input audio signal is dialogue, music, sound effect, or mute and can output the determined result. In another example, the classifier 400 can be used to detect a substantially mono or mono-like audio signal using cross-correlation, as described in U.S. patent application Ser. No. 11/855,500, for "Dialogue Enhancement Techniques," filed Sep. 14, 2007. Using this technique, a dialogue enhancement technique can be applied to an input audio signal if the input audio signal is not substantially mono based on the output of the classifier 400.

The output of the classifier 400 may be a hard decision output such as dialogue or music, or a soft decision output such as a probability or a percentage that dialogue is contained in the input audio signal. Examples of classifiers include but are not limited to: naive Bayes classifiers, Bayesian networks, linear classifiers, Bayesian inference, fuzzy logic, logistic regression, neural networks, predictive analytics, perceptrons, support vector machines (SVMs), etc.

Figure 5A:
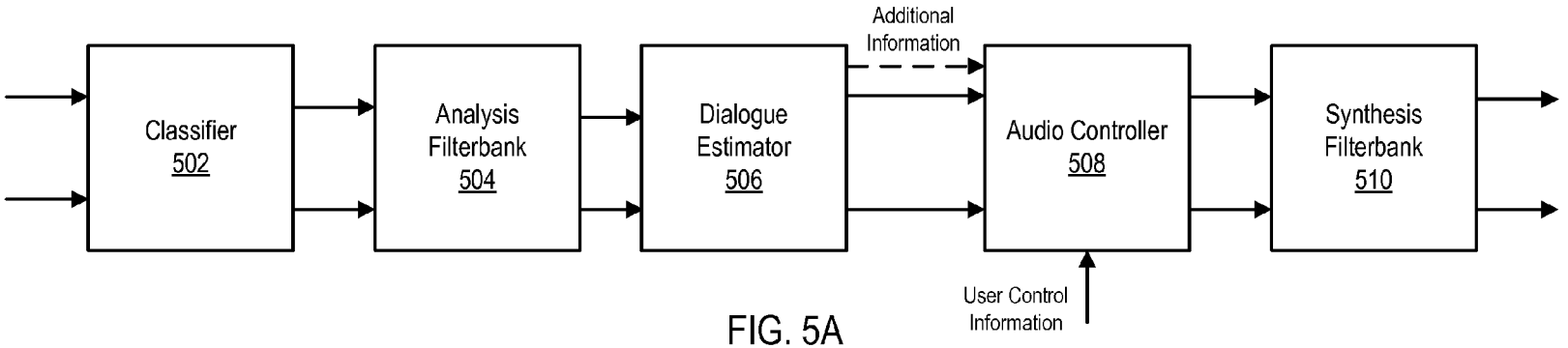
FIGS. 5A-5C are block diagrams showing various possible locations of a classifier in a dialogue enhancement process.
Figure 5B:
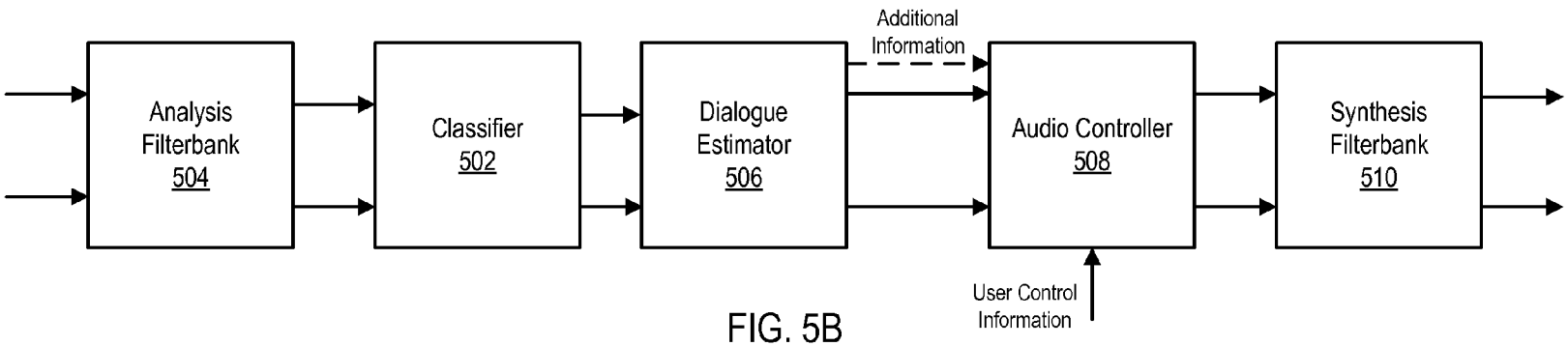
Figure 5C:
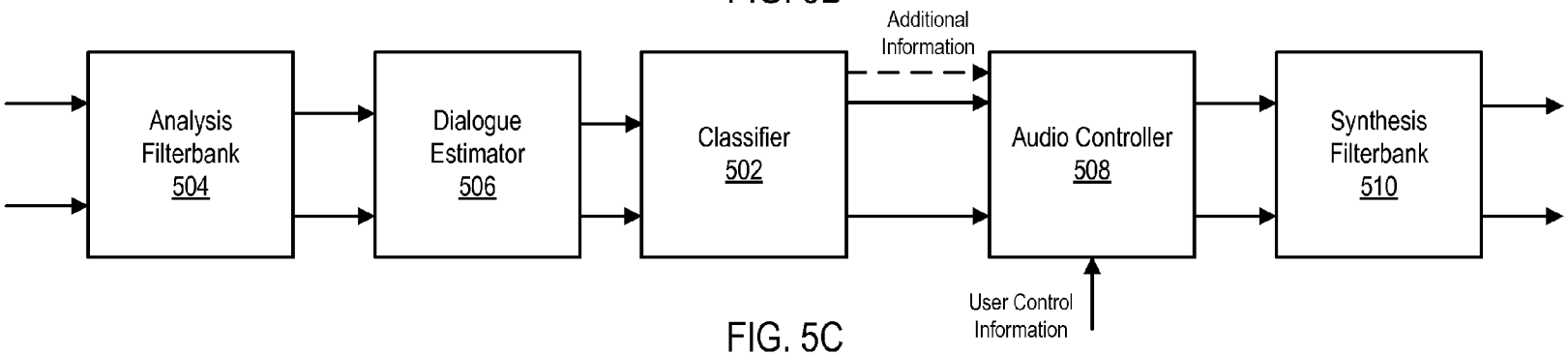

FIGS. 5A-5C are block diagrams showing various possible locations of a classifier 502 in an dialogue enhancement process. In FIG. 5A, if it is determined that the dialogue is contained in the signal by the classifier 502, the subsequent process stages 504, 506, 508 and 510, are performed, and if it is determined that the dialogue is not contained in the signal, then the subsequent process stages can be bypassed. If the user control information relates to the volume of an audio signal other than the dialogue (e.g., the music volume is turned up while the dialogue volume is maintained), the classifier 502 determines that the signal is a music signal and only the music volume can be controlled in the subsequent process stages 504, 506, 508, 510.

In FIG. 5B, the classifier 502 is applied after the analysis filterbank 504. The classifier 502 may have different outputs which are classified according to frequency bands (subbands) at any time point. The characteristics (e.g., the turn up of the dialogue volume, the reduction of reverberation, or the like) of the audio signal reproduced according to the user control information can be controlled.

In FIG. 5C, the classifier 502 is applied after the dialogue estimator 506. This configuration may be efficiently applied when the music signal is concentrated in the center of the sound image and thus is misrecognized as the dialogue region. For example, the classifier 502 can determine if the estimated virtual center channel signal includes a speech component signal. If the virtual center channel signal includes a speech component signal, then gain can be applied to the estimated virtual center channel signal. If the estimated virtual center channel signal is classified as music or some other non-speech component signal then gain may not be applied. Other configurations with classifiers are possible.

Automatic Dialogue Volume Control Function

Figure 6:
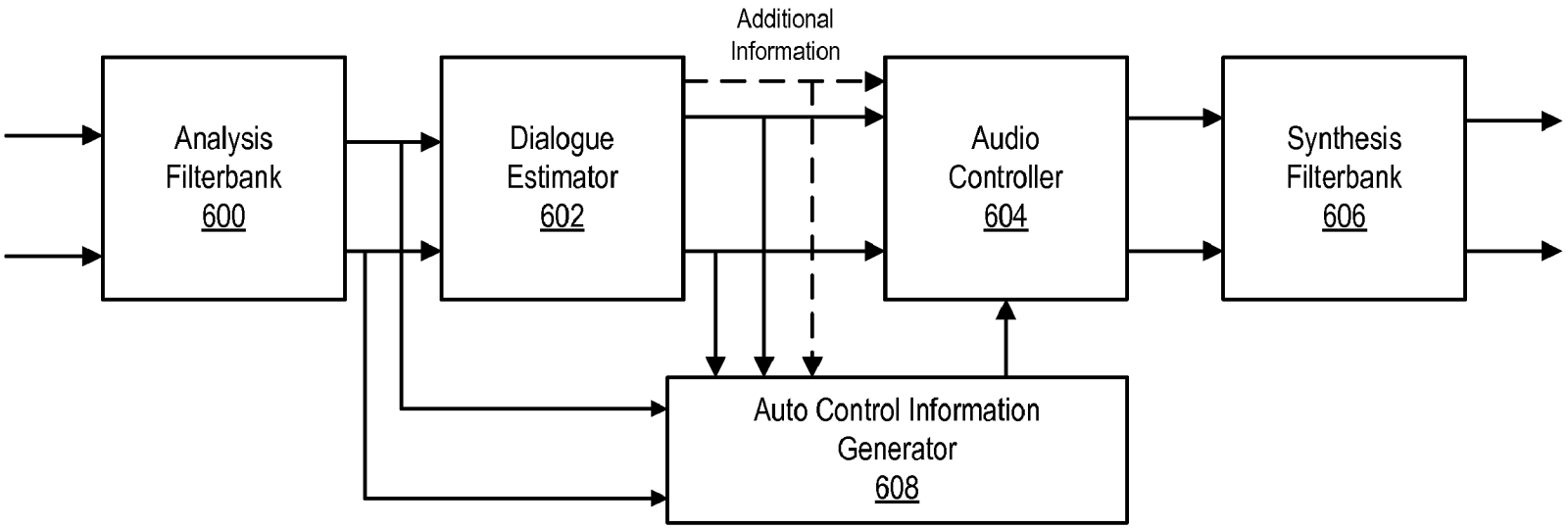
FIG. 6 is a block diagram of an example system for dialogue enhancement, including a classifier that is applied on a time axis.

FIG. 6 is a block diagram of an example system for dialogue enhancement, including an automatic control information generator 608. In FIG. 6, for convenience of description, the classifier block is not shown. It is apparent, however, that a classifier may be included in FIG. 6, similar to FIGS. 4-5. The analysis filterbank 600 and synthesis filterbank 606 (inverse transform) may not be included in cases where subbands are not used.

In some implementations the automatic control information generator 608 compares a ratio of a virtual center channel signal and a plural-channel audio signal. If the ratio is below a first threshold value, the virtual center channel signal can be boosted. If the ratio is above a second threshold value, the virtual center channel signal can be attenuated. For example, if P_dialogue denotes the level of the dialogue region signal and P_input denotes the level of the input signal, the gain can be automatically corrected by the following equation:

$$\text{If } P_ratio = P_dialogue / P_input < P_threshold,$$

$$G_dialogue = function(P_threshold / P_ratio), \quad [6]$$

where, P_ratio is defined by P_dialogue/P_input, P_threshold is a predetermined value, and G_dialogue is a gain value applied to the dialogue region (having the same concept as G_center previously described). P_threshold may be set by the user according to his/her taste.

In other implementations, the relative level may be maintained to be less than a predetermined value using the following equation:

$$\text{If } P_ratio = P_dialogue / P_input > P_threshold2,$$

$$G_dialogue = function(P_threshold2 / P_ratio). \quad [7]$$

The generation of automatic control information maintains the volume of the background music, the volume of reverberation, and the volume of spatial cues as well as the dialogue volume at a relative value desired by the user according to the reproduced audio signal. For example, the user can listen to a dialogue signal with a volume higher than that of the transmitted signal in a noisy environment and the user can listen to the dialogue signal with a volume equal to or less than that of the transmitted signal in a quiet environment.

Method of Efficiently Controlling the Volume of Dialogue Signal

In some implementations, a controller and a method of feeding back information controlled by a user to the user are introduced. For convenience of description, for example, a remote controller of a TV receiver will be described. It is apparent, however, that the disclosed implementations may also apply to a remote controller of an audio device, a digital multimedia broadcast (DMB) player, a portable media player (PMP) player, a DVD player, a car audio player, and a method of controlling a TV receiver and an audio device.

Configuration of Separate Control Device #1

Figure 7:
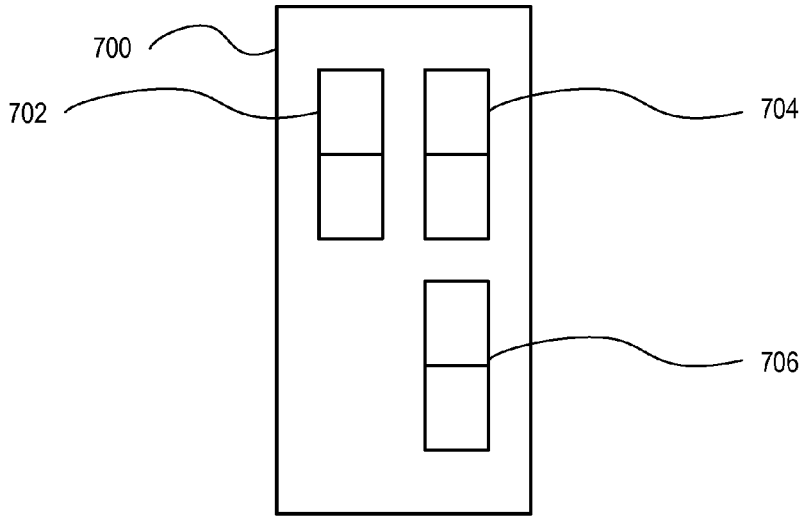
FIG. 7 illustrates an example remote controller for communicating with a general TV receiver or other device, including a separate control device for adjusting dialogue volume.

FIG. 7 illustrates an example remote controller 700 for communicating with a general TV receiver or other devices capable of processing dialogue volume, including a separate input control (e.g., a key, button) for adjusting dialogue volume.

As shown in FIG. 7, the remote controller 700 includes channel control key 702 for controlling (e.g., surfing) channels and a master volume control key 704 for turning up or down a master volume (e.g., volume of whole signal). In addition, a dialogue volume control key 706 is included for turning up or down the volume of a specific audio signal, such as a dialogue signal computed by, for example, a dialogue estimator, as described in reference to FIGS. 4-5.

In some implementations, the remote controller 700 can be used with the dialogue enhancement techniques described in U.S. patent application Ser. No. 11/855,500, for "Dialogue Enhancement Techniques," filed Sep. 14, 2007. In such a case, the remote controller 700 can provide the desired gain $G_d$ and/or the gain factor g(i,k). By using a separate dialogue volume control key 706 for controlling dialogue volume, it is possible for a user to conveniently and efficiently control only the volume of the dialogue signal using the remote controller 700.

Figure 8:
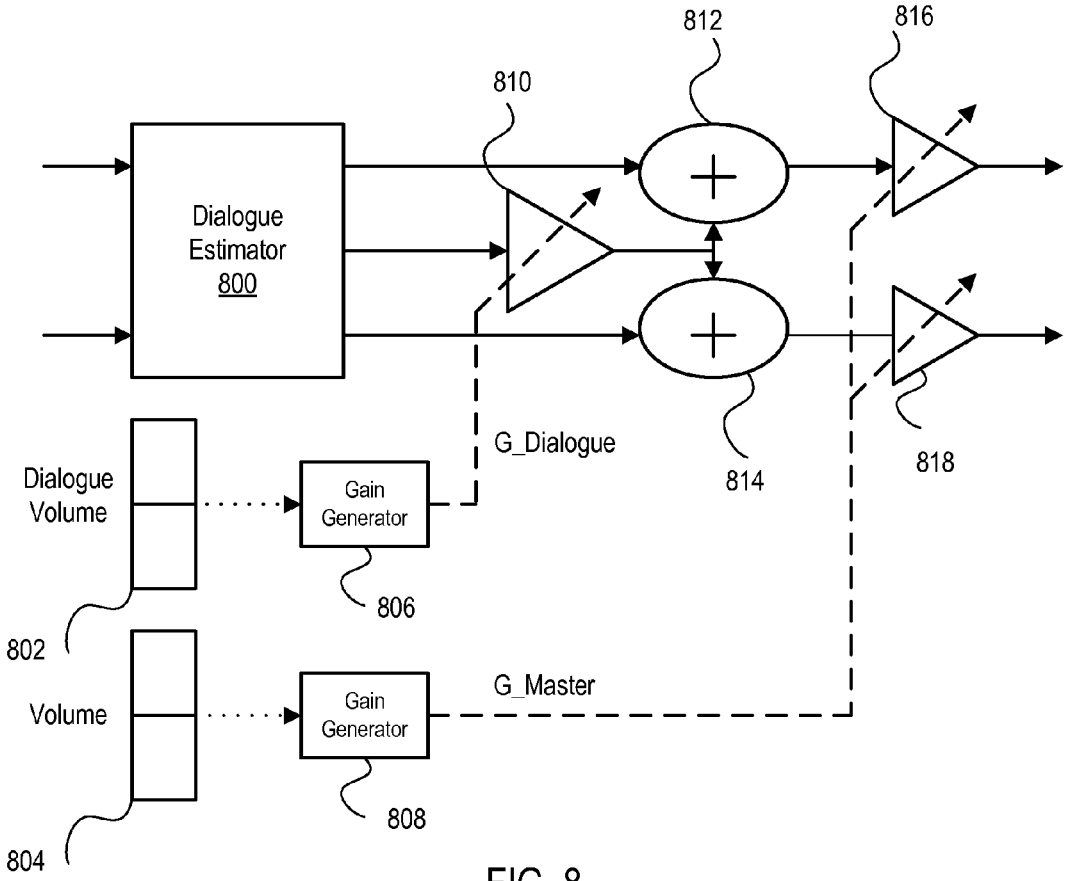
FIG. 8 is a block diagram of an example system for applying the control of a master volume and a dialogue volume to an audio signal.

FIG. 8 is a block diagram illustrating a process of controlling a master volume and a dialogue volume of an audio signal. For convenience of description, the processing stages for dialogue enhancement described in reference to FIGS. 2-10 will be omitted and only necessary portions are shown in FIG. 8. In the example configuration of FIG. 8, a dialogue estimator 800 receives an audio signal and estimates center, left and right channel signals. The center channel (e.g., the estimated dialogue region) is input to an amplifier 810, and the left and right channels are summed with the output of the amplifier 810 using adders 812, 814, respectively. The outputs of the adders 812 and 814 are input into amplifiers 816 and 818, respectively, for controlling the volume of the left and right channels (master volume), respectively.

In some implementations, the dialogue volume can be controlled by a dialogue volume control key 802, which is coupled to a gain generator 806, which outputs a dialogue gain factor G_Dialogue. The left and right volumes can be controlled by a master volume control key 804, which is coupled to a gain generator 808 to provide a master gain G_Master. The gain factors G_Dialogue and G_Master can be used by the amplifiers 810, 816, 818, to adjust the gains of the dialogue and master volumes.

Configuration of Separate Control Device #2

Figure 9:
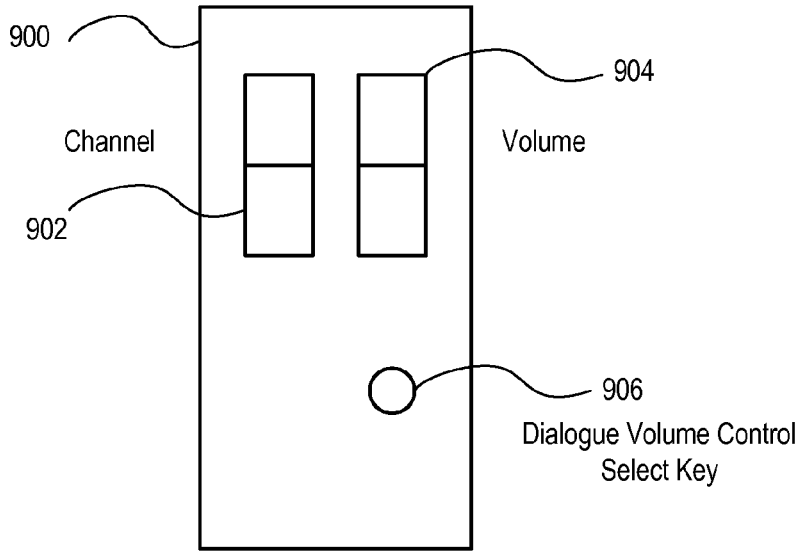
FIG. 9 illustrates an example remote controller for turning on or off dialogue volume.

FIG. 9 illustrates an example remote controller 900 which includes channel and volume control keys 902, 904, respectively, and a dialogue volume control select key 906. The dialogue volume control select key 906 is used to turn on or off dialogue volume control. If the dialogue volume control is turned on, then the volume of a signal of the dialogue region can be turned up or down in a step by step manner (e.g., incrementally) using the volume control key 904. For example, if the dialogue volume control select key 906 is pressed or otherwise activated the dialogue volume control is activated, and the dialogue region signal can be turned up by a predetermined gain value (e.g., 6 dB). If the dialogue volume control select key 906 is pressed again, the volume control key 904 can be used to control the master volume.

Alternatively, if the dialogue volume control select key 906 is turned on, an automatic dialogue control (e.g., automatic control information generator 608) can be operated, as described in reference to FIG. 6. Whenever the volume control key 904 is pressed or otherwise activated, the dialogue gains can be sequentially increased and circulated, for example, in order of 0, 3 dB, 6 dB, 12 dB, and 0. Such a control method allows a user to control dialogue volume in an intuitive manner.

The remote controller 900 is one example of a device for adjusting dialogue volume. Other devices are possible, including but not limited to devices with touch-sensitive displays. The remote control device 900 can communicate with any desired media device for adjusting dialogue gain (e.g., TV, media player, computer, mobile phone, set-top box, DVD player) using any known communication channel (e.g., infrared, radio frequency, cable).

In some implementations, when the dialogue volume control select key 906 is activated, the selection is displayed on a screen, the color or symbol of the dialogue volume control select key 906 can be changed, the color or symbol of the volume control key 904 can be changed, and/or the height of the dialogue volume control select key 906 can be changed, to notify the user that the function of the volume control key 904 has changed. A variety of other methods of notifying the user of the selection on the remote controller are also possible, such as audible or force feedback, a text message or graphic presented on a display of the remote controller or on a TV screen, monitor, etc.

The advantage of such a control method is to allow the user to control the volume in an intuitive manner and to prevent the number of buttons or keys on the remote controller from increasing to control a variety of audio signals, such as the dialogue, background music, reverberant signal, etc. When a variety of audio signals are controlled, a particular component signal of the audio signal to be controlled can be selected using the dialogue volume control select key 906. Such component signals can include but are not limited to: a dialogue signal, background music, a sound effect, etc.

Methods of Notifying User of Control Information

Method of Using OSD #1

In the following examples, an On Screen Display (OSD) of a TV receiver is described. It is apparent, however, that the present invention may apply to other types of media which can display the status of an apparatus, such as an OSD of an amplifier, an OSD of a PMP, an LCD window of an amplifier/PMP, etc.

Figure 10:
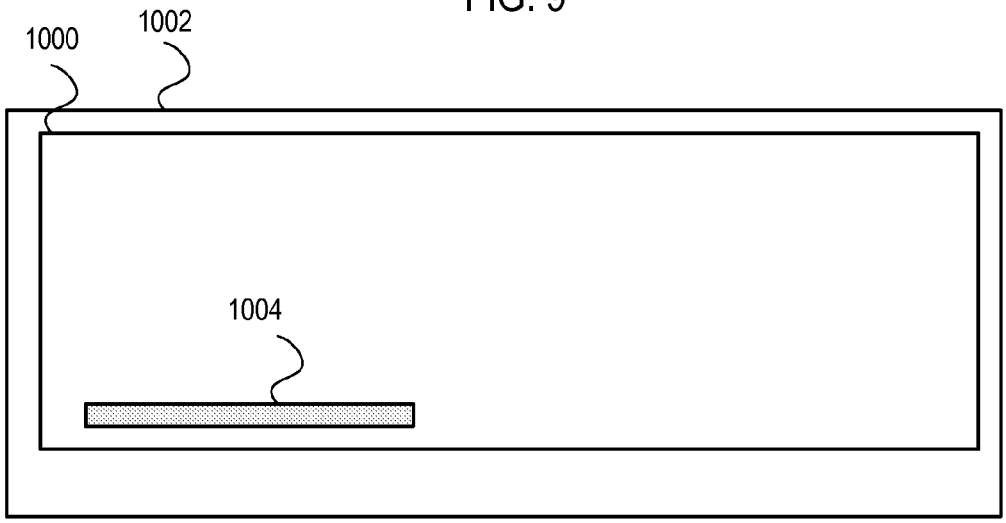
FIG. 10 illustrates an example On Screen Display (OSD) of a TV receiver for displaying dialogue volume control information.

FIG. 10 shows an OSD 1000 of a general TV receiver 1002. A variation in dialogue volume may be represented by numerals or in the form of a bar 1004 as shown in FIG. 12. In some implementations, dialogue volume can be displayed alone as a relative level (FIG. 10), or as a ratio with the master volume or other component signal, as shown in FIG. 11.

Figure 11:
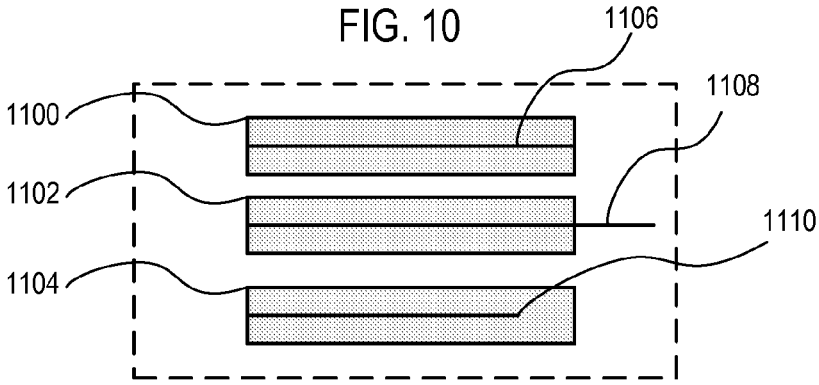
FIG. 11 illustrates an example method of displaying a graphical object for indicating dialogue.
Figure 12:
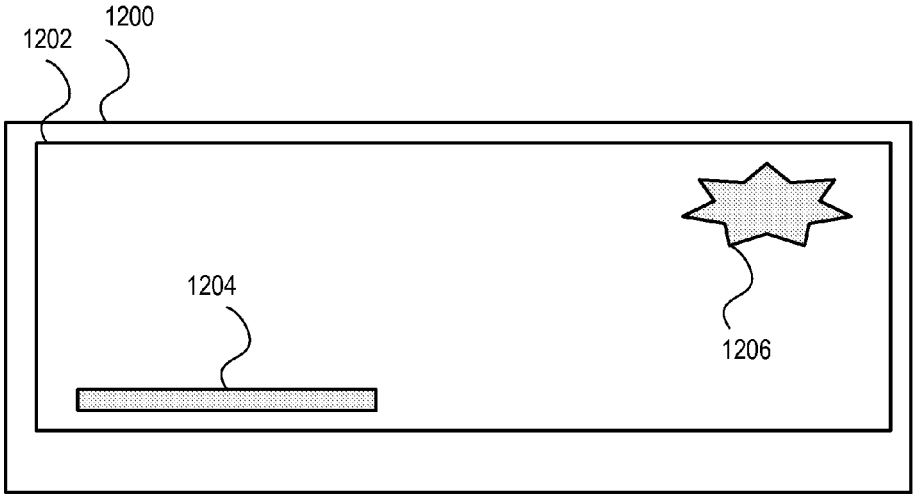
FIG. 12 illustrates an example of a method of displaying a dialogue volume level and on/off status of dialogue volume control on a display of a device.

FIG. 11 illustrates a method of displaying a graphical object (e.g., a bar, line) master volume and a dialogue volume. In the example of FIG. 11, the bar indicates the master volume and the length of the line drawn in the middle portion of the bar indicates the level of the dialogue volume. For example, the line 1106 in bar 1100 notifies the user that the dialogue volume is not controlled. If the volume is not controlled, the dialogue volume has the same value as the master volume. The line 1108 in bar 1102 notifies the user that the dialogue volume is turned up, and the line 1110 in bar 1104 notifies the user that the dialogue volume is turned down.

The display methods described in reference to FIG. 11 are advantageous in that the dialogue volume is more efficiently controlled since the user can know the relative value of the dialogue volume. In addition, since the dialogue volume bar is displayed together with the master volume bar, it is possible to efficiently and consistently configure the OSD 1000.

The disclosed implementations are not limited to the bar type display shown in FIG. 11. Rather, any graphical object capable of simultaneously displaying the master volume and a specific volume to be controlled (e.g., the dialogue volume), and for providing a relative comparison between the volume to be controlled and the master volume, can be used. For example, two bars may be separately displayed or overlapping bars having different colors and/or widths may be displayed together.

If the number of types of the volumes to be controlled is two or more, the volumes can be displayed by the method described immediately above. However, if the number of volumes to be controlled separately is three or more, a method of displaying only information on the volume being currently controlled may be also used to prevent the user from becoming confused. For example, if the reverberation and dialogue volumes can be controlled but only the reverberation volume is controlled while the dialogue volume is maintained at its present level, only the master volume and reverberation volume are displayed, for example, using the above-described method. In this example, it is preferable that the master and reverberation volumes have different colors or shapes so they can be identified in an intuitive manner.

Method of Using OSD #2

FIG. 12 illustrates an example of a method of displaying a dialogue volume on a OSD 1202 of a device 1200 (e.g., a TV receiver). In some implementations, dialogue level information 1206 may be displayed separately from a volume bar 1204. The dialogue level information 1206 can be displayed in various sizes, fonts, colors, brightness levels, flashing or with any other visual embellishments or indicia. Such a display method may be more efficiently used when the volume is circularly controlled in a step by step manner, as described in reference to FIG. 9. In some implementations, dialogue volume can be displayed alone as a relative level or as a ratio with the master volume or other component signals.

Figure 13:
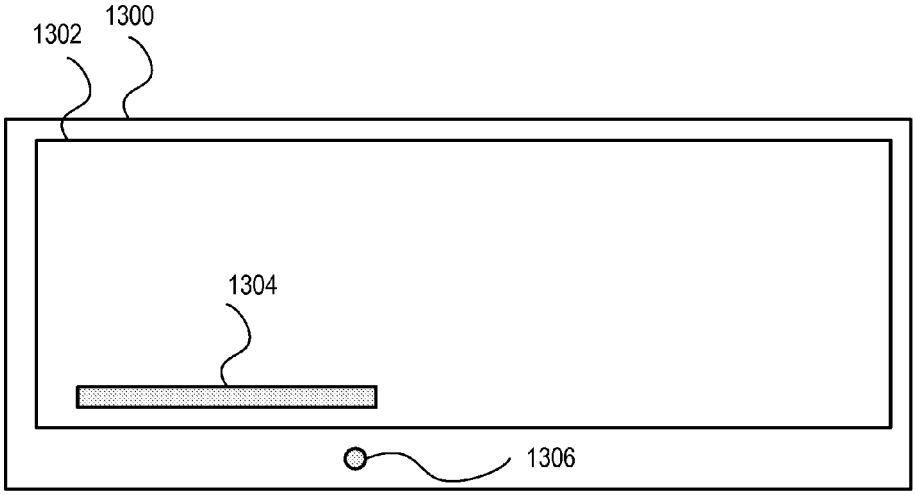
FIG. 13 illustrates a separate indicator for indicating a type of volume to be controlled and on/off status of dialogue volume control.

As shown in FIG. 13, a separate indicator 1306 for dialogue volume may be used instead of, or in addition to, displaying the type of the volume to be controlled on the OSD 1302 of a device 1300. An advantage of such a display is that the content viewed on the screen will be less affected (e.g., obscured) by the displayed volume information.

Display of Control Device

In some implementations, when the dialogue volume control select key 906 (FIG. 9) is selected, the color of the dialogue volume control select key 906 can be changed to notify the user that the function of the volume key has changed. Alternatively, changing the color or height of the volume control key 904 when the dialogue volume control select key 906 is activated may be used.

Digital Television System Example

Figure 14:
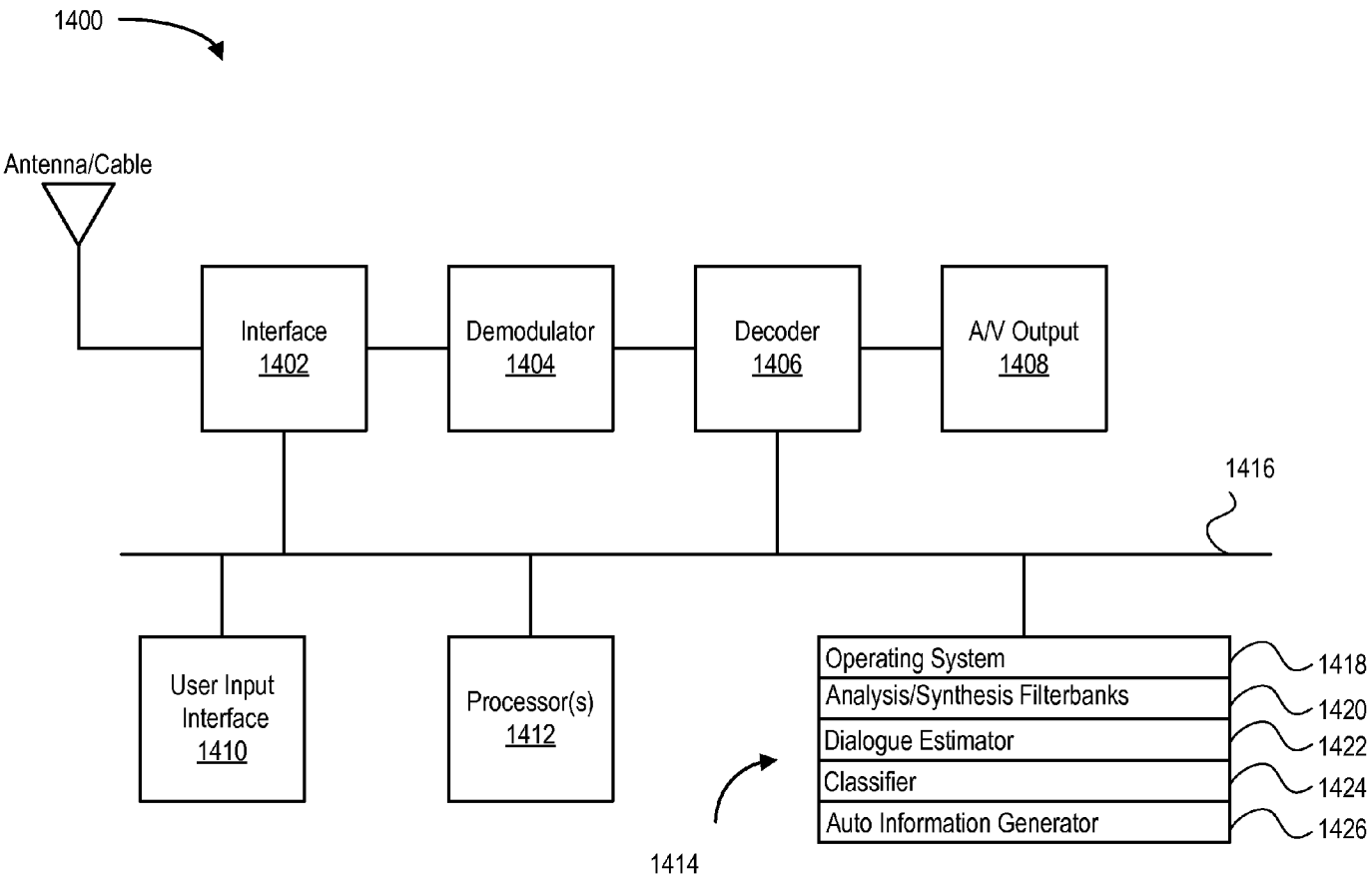
FIG. 14 is a block diagram of a digital television system for implementing the features and processes described in reference to FIGS. 1-13.

FIG. 14 is a block diagram of a an example digital television system 1400 for implementing the features and processes described in reference to FIGS. 1-14. Digital television (DTV) is a telecommunication system for broadcasting and receiving moving pictures and sound by means of digital signals. DTV uses digital modulation data, which is digitally compressed and requires decoding by a specially designed television set, or a standard receiver with a set-top box, or a PC fitted with a television card. Although the system in FIG. 14 is a DTV system, the disclosed implementations for dialogue enhancement can also be applied to analog TV systems or any other systems capable of dialogue enhancement.

In some implementations, the system 1400 can include an interface 1402, a demodulator 1404, a decoder 1406, and audio/visual output 1408, a user input interface 1410, one or more processors 1412 (e.g., Intel® processors) and one or more computer readable mediums 1414 (e.g., RAM, ROM, SDRAM, hard disk, optical disk, flash memory, SAN, etc.). Each of these components are coupled to one or more communication channels 1416 (e.g., buses). In some implementations, the interface 1402 includes various circuits for obtaining an audio signal or a combined audio/video signal. For example, in an analog television system an interface can include antenna electronics, a tuner or mixer, a radio frequency (RF) amplifier, a local oscillator, an intermediate frequency (IF) amplifier, one or more filters, a demodulator, an audio amplifier, etc. Other implementations of the system 1400 are possible, including implementations with more or fewer components.

The tuner 1402 can be a DTV tuner for receiving a digital televisions signal include video and audio content. The demodulator 1404 extracts video and audio signals from the digital television signal. If the video and audio signals are encoded (e.g., MPEG encoded), the decoder 1406 decodes those signals. The A/V output can be any device capable of display video and playing audio (e.g., TV display, computer monitor, LCD, speakers, audio systems).

In some implementations, the user input interface can include circuitry and/or software for receiving and decoding infrared or wireless signals generated by a remote controller (e.g., remote controller 900 of FIG. 9).

In some implementations, the one or more processors can execute code stored in the computer-readable medium 1414 to implement the features and operations 1418, 1420, 1422, 1424 and 1426, as described in reference to FIGS. 1-13.

The computer-readable medium further includes an operating system 1418, analysis/synthesis filterbanks 1420, a dialogue estimator 1422, a classifier 1424 and an auto information generator 1426. The term "computer-readable medium" refers to any medium that participates in providing instructions to a processor 1412 for execution, including without limitation, non-volatile media (e.g., optical or magnetic disks), volatile media (e.g., memory) and transmission media. Transmission media includes, without limitation, coaxial cables, copper wire and fiber optics. Transmission media can also take the form of acoustic, light or radio frequency waves.

The operating system 1418 can be multi-user, multiprocessing, multitasking, multithreading, real time, etc. The operating system 1418 performs basic tasks, including but not limited to: recognizing input from the user input interface 1410; keeping track and managing files and directories on computer-readable medium 1414 (e.g., memory or a storage device); controlling peripheral devices; and managing traffic on the one or more communication channels 1416.

The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language (e.g., Objective-C, Java), including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors or cores, of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer.

The features can be implemented in a computer system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include, e.g., a LAN, a WAN, and the computers and networks forming the Internet.

The computer system can include clients and servers. A client and server are generally remote from each other and typically interact through a network. The relationship of client and server arises by virtue of computer programs running on the respective computers and having a client-server relationship to each other.

A number of implementations have been described. Nevertheless, it will be understood that various modifications may be made. For example, elements of one or more implementations may be combined, deleted, modified, or supplemented to form further implementations. As yet another example, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. An apparatus for processing a multi-channel audio signal, comprising:

a dialogue estimator configurable for receiving the multi-channel audio signal including at least a dialogue signal, for determining a gain value for at least one channel of the multi-channel audio signal, for determining an inter-channel correlation between at least two channels, determining a location of the dialogue signal based on at least one of the gain value and the inter-channel correlation, and for identifying the dialogue signal based on the location of the dialogue signal;

a dialogue volume control;

a master volume control; and a circuit operatively coupled to the dialogue volume control, the master volume control and the dialog estimator, configurable for receiving at least one of a dialogue control signal and a master control signal, the dialogue control signal being used for adjusting the dialogue volume of the identified dialogue signal and the master control signal being used for adjusting the master volume of the multi-channel audio signal, respectively, and modifying at least one of the dialogue volume and the master volume based on at least one of the dialogue volume control signal and the master volume control signal.

2. The apparatus of claim 1, wherein the dialogue volume control signal is used for adjusting dialogue volume level of an audio signal relative to the master volume level or the volume level of one or more other audio signals.

3. The apparatus of claim 1, wherein the dialogue volume control signal is used for boosting or attenuating dialogue volume.

4. The apparatus of claim 1, where the dialogue volume of the audio signal increases or decreases incrementally by a predetermined amount in response to user interaction with the dialogue volume control.

5. The apparatus of claim 1, where the visual appearance of the dialogue volume control or the master volume control is modified to indicate its function or activation.

6. The apparatus of claim 1, where the dialogue volume control signal is used to generate one or more graphical objects on a display device for providing visual feedback indicating dialogue volume level.

7. The apparatus of claim 6, where a first graphical object indicates master volume level and a second graphical object indicates dialogue volume level relative to master volume level or relative to a volume level of another audio signal.

8. The apparatus of claim 1, where the dialogue volume control signal is used to generate an indicator that dialogue volume control is active.

9. The apparatus of claim 1, wherein the multi-channel audio signal further includes a background signal.

10. The apparatus of claim 1, further comprising a classifier to determine a probability that the dialogue signal is included in the multi-channel audio signal, and wherein the dialogue estimator determines the location of the dialogue signal if the classifier determines the dialogue signal is included in the multi-channel audio signal.

11. A method for processing a multi-channel audio signal, comprising:

receiving the multi-channel audio signal including at least a dialogue signal;

determining a gain value for the multi-channel audio signal;

determining an inter-channel correlation between at least two channels;

determining a location of the dialogue signal based on at least one of the gain value and the inter-channel correlation;

identifying the dialogue signal based on the location of the dialogue signal;

receiving at least one of a dialogue control signal and a master control signal, the dialogue control signal being used for adjusting the dialogue volume of the identified dialogue signal and the master control signal being used for adjusting the master volume of the multi-channel audio signal, respectively; and modifying at least one of the dialogue volume and the master volume based on at least one of the dialogue volume control signal and the master volume control signal.

12. The method of claim 11, wherein the dialogue volume control signal is used for adjusting dialogue volume level of an audio signal relative to the master volume level or the volume level of one or more other audio signals.

13. The method of claim 11, wherein the dialogue volume control signal is used for boosting or attenuating dialogue volume.

14. The method of claim 11, wherein the multi-channel audio signal further includes a background signal.

15. The method of claim 11, further comprising:

determining a probability that the dialogue signal is included in the multi-channel audio signal, wherein the step for determining the location of the dialogue signal determines the location of the dialogue signal if it is determined that the dialogue signal is included in the multi-channel audio signal.

* * * * *

UNITED STATES PATENT AND TRADEMARK OFFICE

CERTIFICATE OF CORRECTION

PATENT NO. : 8,184,834 B2
APPLICATION NO. : 11/855570
DATED : May 22, 2012
INVENTOR(S) : Oh et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1168 days.

Signed and Sealed this
Twenty-fifth Day of September, 2012

David J. Kappos

David J. Kappos
*Director of the United States Patent and Trademark Office*